US007735475B2

(12) United States Patent
Farrell et al.

(10) Patent No.: US 7,735,475 B2
(45) Date of Patent: Jun. 15, 2010

(54) FUEL INJECTION BODY SIZED TO REPLACE CARBURETOR BODY

(76) Inventors: Kenneth William Farrell, 920 Shepard Crest Dr., Corona, CA (US) 92882; Warren Lamont Duff, 43935 Highlander Dr., Temecula, CA (US) 92592

( * ) Notice: Subject to any disclaimer, the term of this patent is extended or adjusted under 35 U.S.C. 154(b) by 76 days.

(21) Appl. No.: 12/234,370

(22) Filed: Sep. 19, 2008

(65) Prior Publication Data

US 2009/0145406 A1 Jun. 11, 2009

Related U.S. Application Data

(60) Provisional application No. 60/979,702, filed on Oct. 12, 2007, provisional application No. 61/052,903, filed on May 13, 2008.

(51) Int. Cl.
*F02M 39/00* (2006.01)
*F02M 61/14* (2006.01)

(52) U.S. Cl. ..... 123/470; 123/445; 123/472; 123/336; 123/337; 261/116

(58) Field of Classification Search ..... 123/336, 123/337, 445, 470, 471, 472; 261/116
See application file for complete search history.

(56) References Cited

U.S. PATENT DOCUMENTS

| | | | | | |
|---|---|---|---|---|---|
| 3,943,904 | A * | 3/1976 | Byrne | 123/470 |
| 4,212,277 | A * | 7/1980 | Melotti | 123/434 |
| 4,341,193 | A * | 7/1982 | Bowler | 123/472 |
| 4,347,823 | A * | 9/1982 | Kessler et al. | 123/472 |
| 4,372,271 | A * | 2/1983 | Elpern et al. | 123/445 |
| 4,817,569 | A * | 4/1989 | Takano et al. | 123/470 |
| 5,012,780 | A | 5/1991 | Bugamelli | |
| 5,205,264 | A * | 4/1993 | Hoffman, Sr. | 123/555 |
| 5,261,382 | A | 11/1993 | Nikolai | |
| 5,447,140 | A * | 9/1995 | Brisbane et al. | 123/456 |
| 5,608,632 | A * | 3/1997 | White | 701/103 |
| 6,467,465 | B1 * | 10/2002 | Lorts | 123/527 |
| 7,055,513 | B1 * | 6/2006 | Boveia | 123/590 |
| 2005/0045147 | A1 * | 3/2005 | Ishikawa et al. | 123/336 |

* cited by examiner

*Primary Examiner*—Erick Solis
(74) *Attorney, Agent, or Firm*—Knobbe, Martens, Olson & Bear, LLP

(57) ABSTRACT

A fuel injection unit is designed for replacement of existing carburetors. The fuel injection unit can be sized similarly to the existing carburetor. The fuel injection unit can have concealed fuel injectors. End caps can be provided that overlie the fuel injectors and that contain fuel line connections. The end caps provide an appearance of carburetor fuel bowls while generally concealing the fuel injectors and the associated fluid connections.

16 Claims, 15 Drawing Sheets

FUEL INJECTION BODY SIZED TO REPLACE CARBURETOR BODY

CROSS-REFERENCE TO RELATED APPLICATIONS

This application claims the priority benefit under 35 U.S.C. §119(e) of U.S. Provisional Patent Application No. 60/979,702, filed on Oct. 12, 2007 and U.S. Provisional Patent Application No. 61/052,903, filed on May 13, 2008, which are hereby incorporated by reference in their entirety.

BACKGROUND OF THE INVENTION

1. Field of the Invention

The present invention generally relates to fuel injection systems for motor vehicles. More particularly, the present invention relates to such systems that are sized and configured to replace a carburetor.

2. Description of the Related Art

Carbureted automobiles ceased to be manufactured in large numbers. The carburetor was replaced with electronic fuel injection (EFI), which has become the standard of the auto manufacturing industry. The hot rod industry and the after-market industry in general are beginning to accept EFI as an alternative to carburetion.

EFI has a number of performance advantages. For example, a computer-controlled engine is easier to start and is more drivable. The engine operates with less hesitation and reduced incidences of stalling. Moreover, EFI provides increased fuel efficiency and reduced emissions. An EFI engine can respond more quickly and precisely to the changing boost levels of turbochargers or superchargers. Furthermore, EFI engines are more consistent when operating around steep inclines and over bumpy terrain.

SUMMARY OF THE INVENTION

Even with the performance advantages of EFI engines, the hot rod industry and the aftermarket industry in general still crave the sleek wireless appearance of a carbureted engine.

Thus, one aspect of the present invention involves a fuel injection unit comprising a main throttle body. The main throttle body comprises a first side surface, a second side surface, a top surface generally extending between the first side surface and the second side surface, and a bottom surface generally extending between the first side surface and the second side surface. A first end cap can be secured to the first side surface and a second end cap can be secured to the second side surface. A first air passage extends between the top surface and the bottom surface and a second air passage extends between the top surface and the bottom surface. A first fuel injector extends through the first side surface toward the first air passage and the first fuel injector is generally covered by the first end cap. A second fuel injector extends through the second side surface toward the second air passage and the second fuel injector is generally covered by the second end cap.

Another aspect of the present invention involves an auxiliary fuel injector plate. The auxiliary fuel injector plate comprises a top surface, a bottom surface spaced from and generally parallel to the top surface and a central passageway extending from the top surface to the bottom surface. An adaptor is positioned within the central passageway. The adaptor comprises a plurality of openings. A first fuel injector extends into the central passageway. A first fuel rail is mounted to the auxiliary fuel injector plate and extends laterally outward from the auxiliary fuel injector plate. The first fuel rail defines a fuel passage that is in fluid communication with the first fuel injector.

BRIEF DESCRIPTION OF THE DRAWINGS

These and other features, aspects and advantages of the present invention will now be described with reference to the drawings of a preferred embodiment, which embodiment is intended to illustrate and not to limit the present invention.

DETAILED DESCRIPTION OF THE PREFERRED EMBODIMENT

Figure 1:
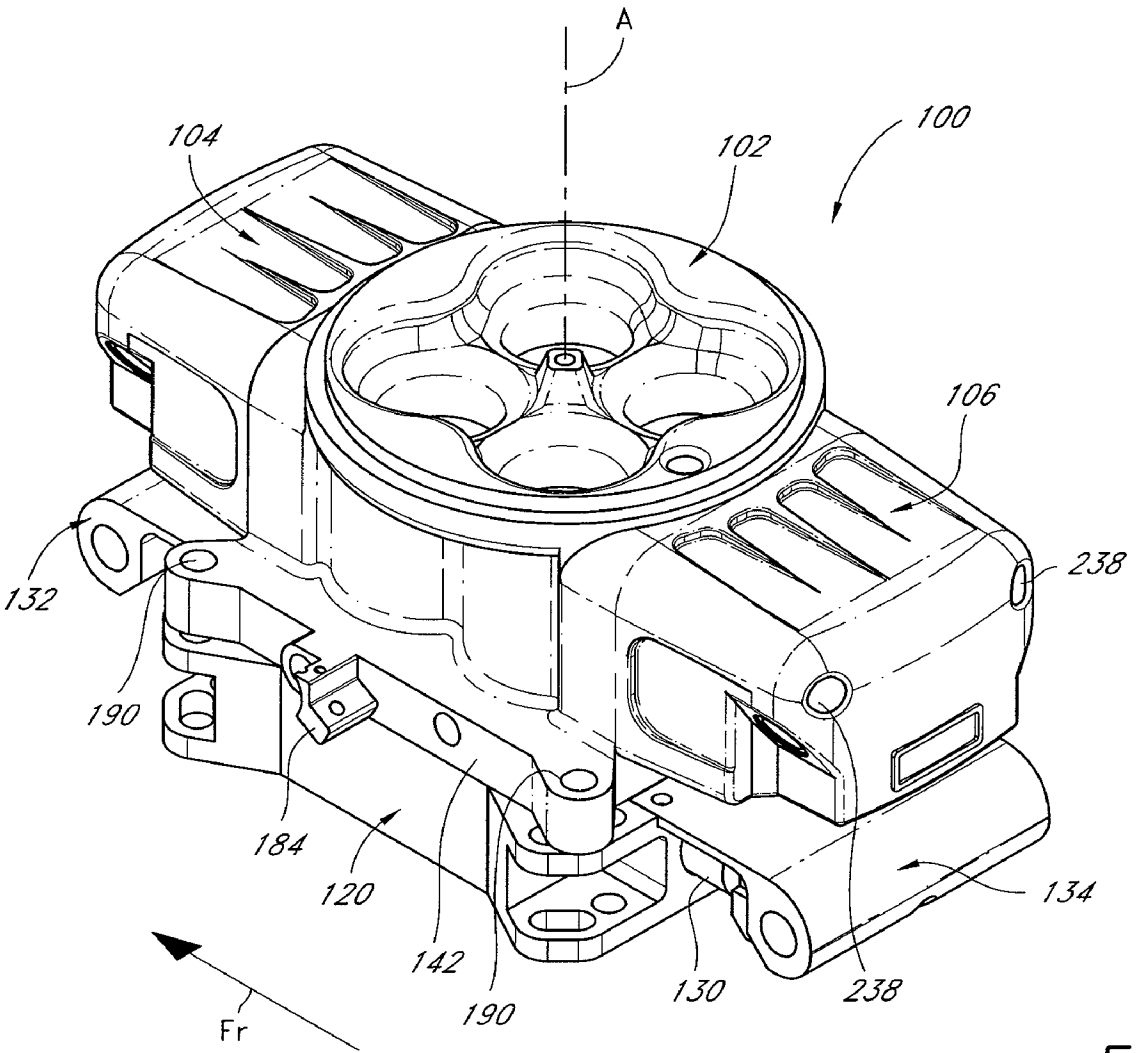
FIG. 1 is a perspective view of a fuel injection unit that is arranged and configured in accordance with certain features, aspects and advantages of the present invention.

With reference initially to FIG. 1, a fuel injection body 100 is shown in perspective view. The fuel injection body 100 advantageously is sized and configured to replace a carburetor, such as a standard 4150 double pumper carburetor. As will be described, the fuel injection body advantageously can be bolted to most factory and after-market manifolds. In a few instances, such as applications involving spread bore manifolds, adaptor plates can be obtained from any suitable source.

Figure 2:
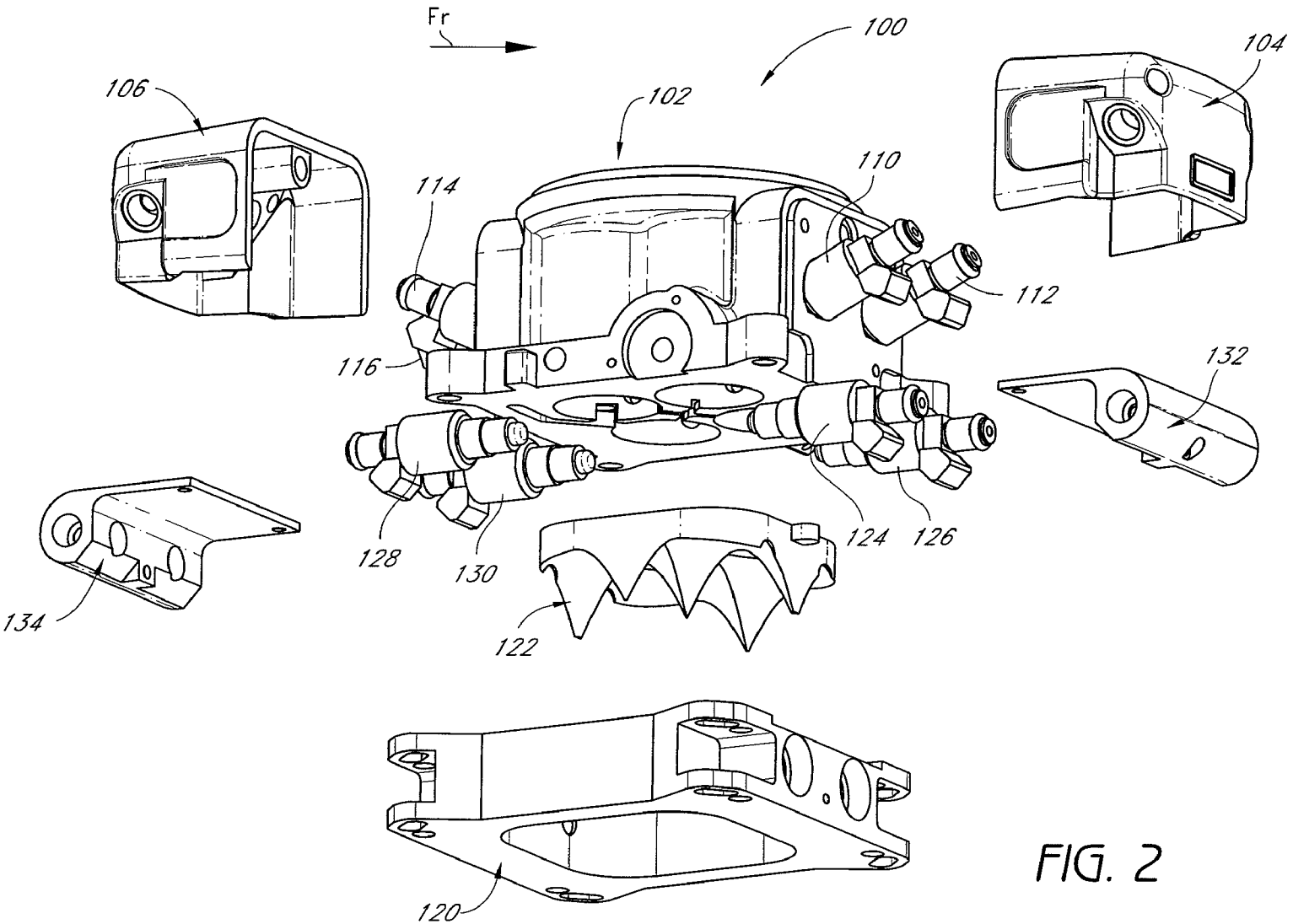
FIG. 2 is an exploded perspective view of the fuel injection unit of FIG. 1.

With reference to FIG. 2, the fuel injection body 100 is shown in an exploded view. It should be noted that FIG. 2 shows the fuel injection body 100 after being rotated about 180 degrees about a generally vertical axis A relative to the view of FIG. 1. As shown, the fuel injection body 100 comprises a main throttle body 102, a first end cap 104 and a second end cap 106. Each of the end caps 104, 106 generally covers two fuel injectors, for a total of four fuel injectors 110, 112, 114, 116, that are mounted to the main throttle body 102.

With continued reference to FIGS. 1 and 2, an injector plate 120 can be mounted adjacent to the fuel injection body 100. As will be discussed below in greater detail, an adaptor 122 can be formed separately of, or integrally with, the injector plate 120 and can be positioned within at least a portion of the injector plate 120. Four fuel injectors 124, 126, 128, 130 can be mounted to the injector plate 120. In the illustrated configuration, a first fuel rail 132 is connected to two of the fuel injectors 124, 126 while a second fuel rail 134 is connected to the other two of the fuel injectors 128, 130.

Figure 3:
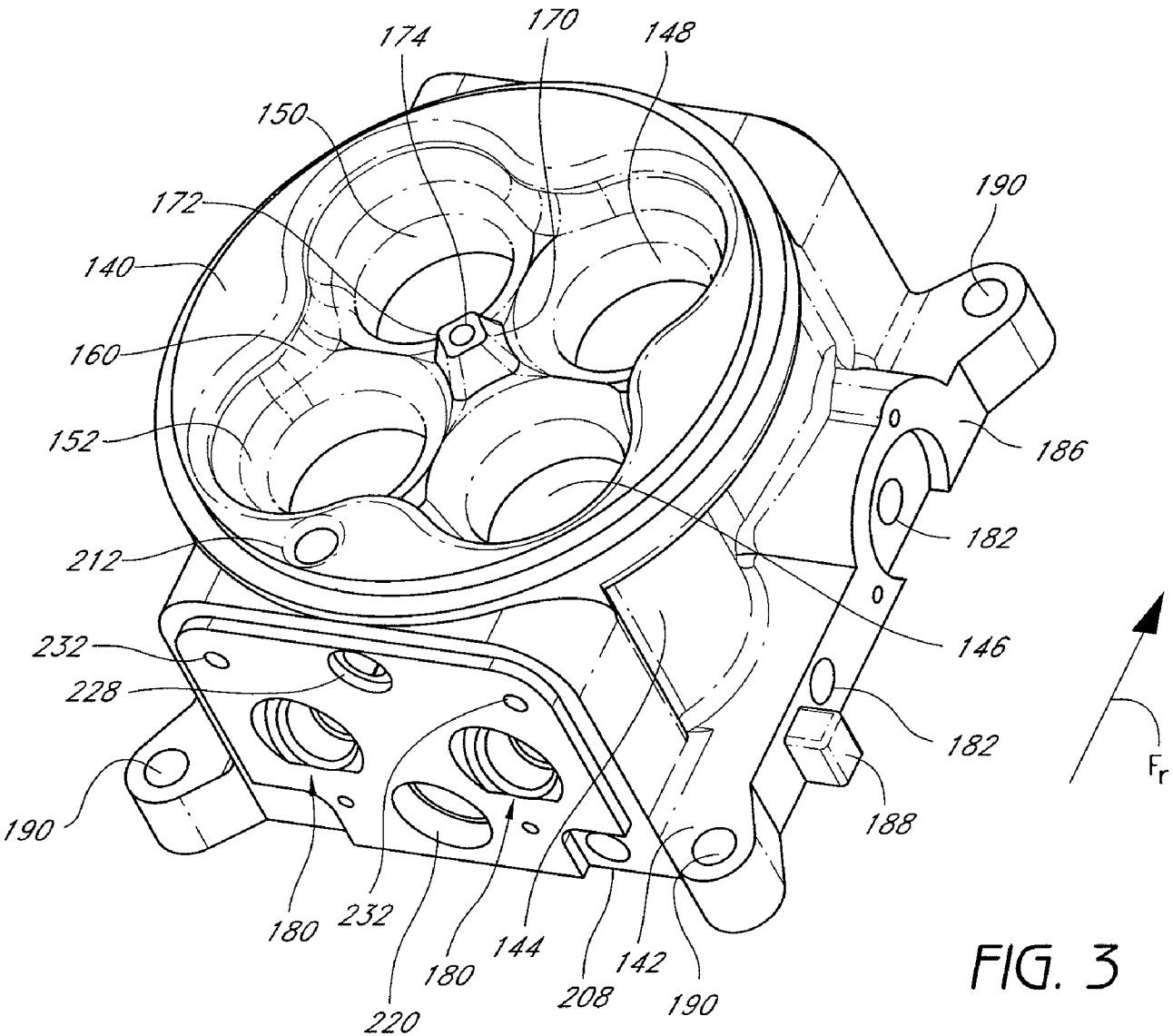
FIG. 3 is a perspective view of a throttle body of the fuel injection unit of FIG. 1.
Figure 4:
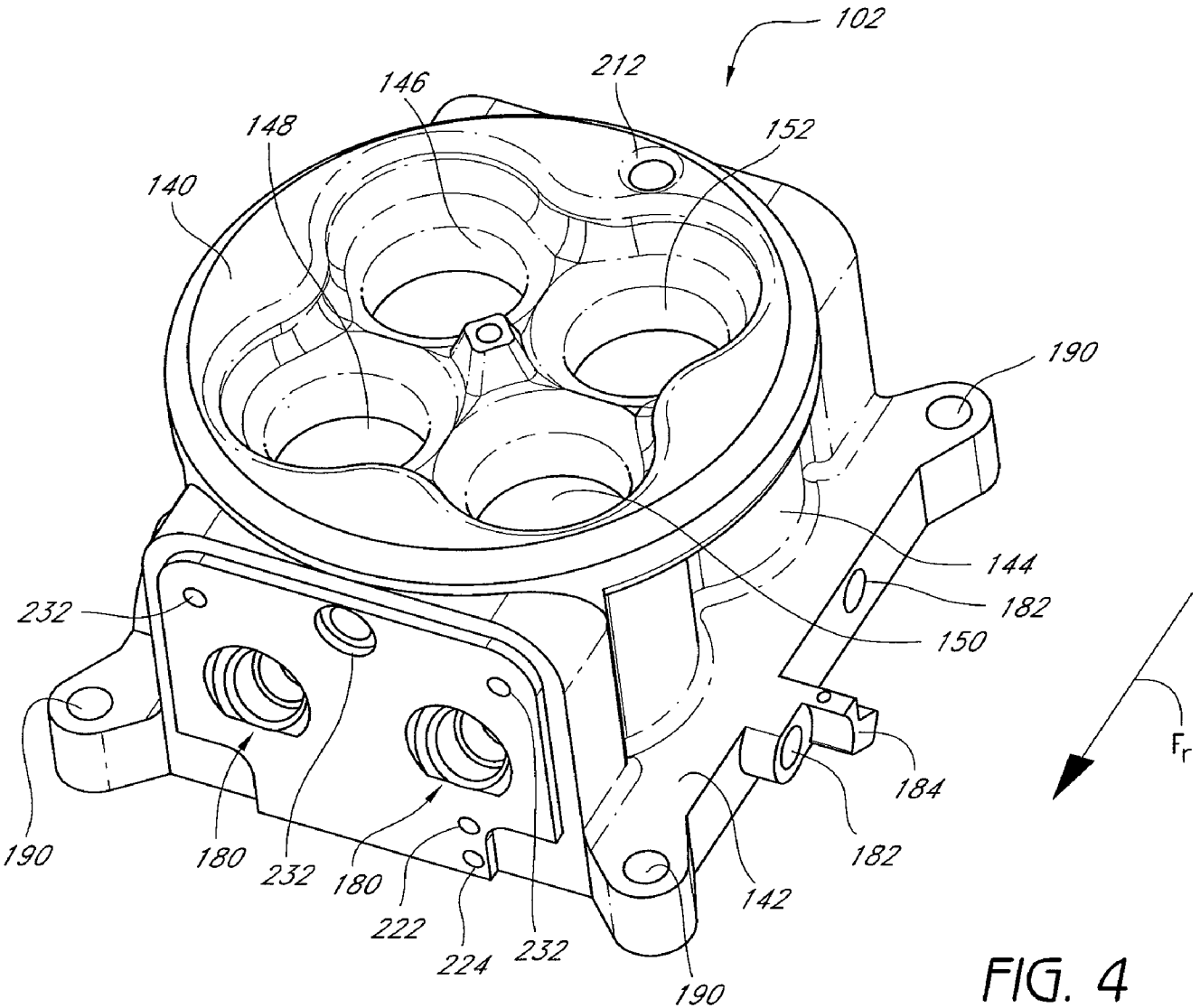
FIG. 4 is another perspective view of the throttle body of FIG. 3.

Having introduced the basic components of the fuel injection body, each of the components will be described in greater detail starting with the main throttle body 102. With reference to FIGS. 3 and 4, the illustrated throttle body 102 is generally cubic in configuration. A top surface 140 of the throttle body 102 is generally circular or cylindrical in configuration when viewed from the top. A lower flange 142 is generally square when viewed from the bottom. Other configurations can be used. The top surface 140 and the lower flange 142 are spaced apart by a main portion 144 of the main throttle body 102.

Four passages 146, 148, 150, 152 extend through at least a majority of the main portion 144 from the top surface 140 through the lower flange 142. As shown in the cross-section of FIG. 5, each of the passages 146, 148, 150, 152 preferably comprises an expanding portion 154 that extends between a generally cylindrical upper portion 156 and a generally cylindrical lower portion 158. The profile of each of the passages 146, 148, 150, 152 preferably defines a venturi in cooperation with a recess 160 formed by entrances into the passages 146, 148, 150, 152. The venturi consists of a generally tubular shape that is generally constricted in the middle and that is flared at both ends. Air flowing through the venturi will increase in velocity through the constricted portion and the air pressure will drop while passing through the constricted portion. The venturi can be bored out to approximately 1000 cfm in some embodiments.

In the illustrated configuration, the clover shaped recess 160 (see FIG. 3) is disposed between the top surface 140 and the passages 146, 148, 150, 152. The recess 154 provides an attractive appearance while also generally defining four surfaces that taper the from a larger diameter down to a diameter of the corresponding passages 146, 148, 150, 152.

Figure 6:
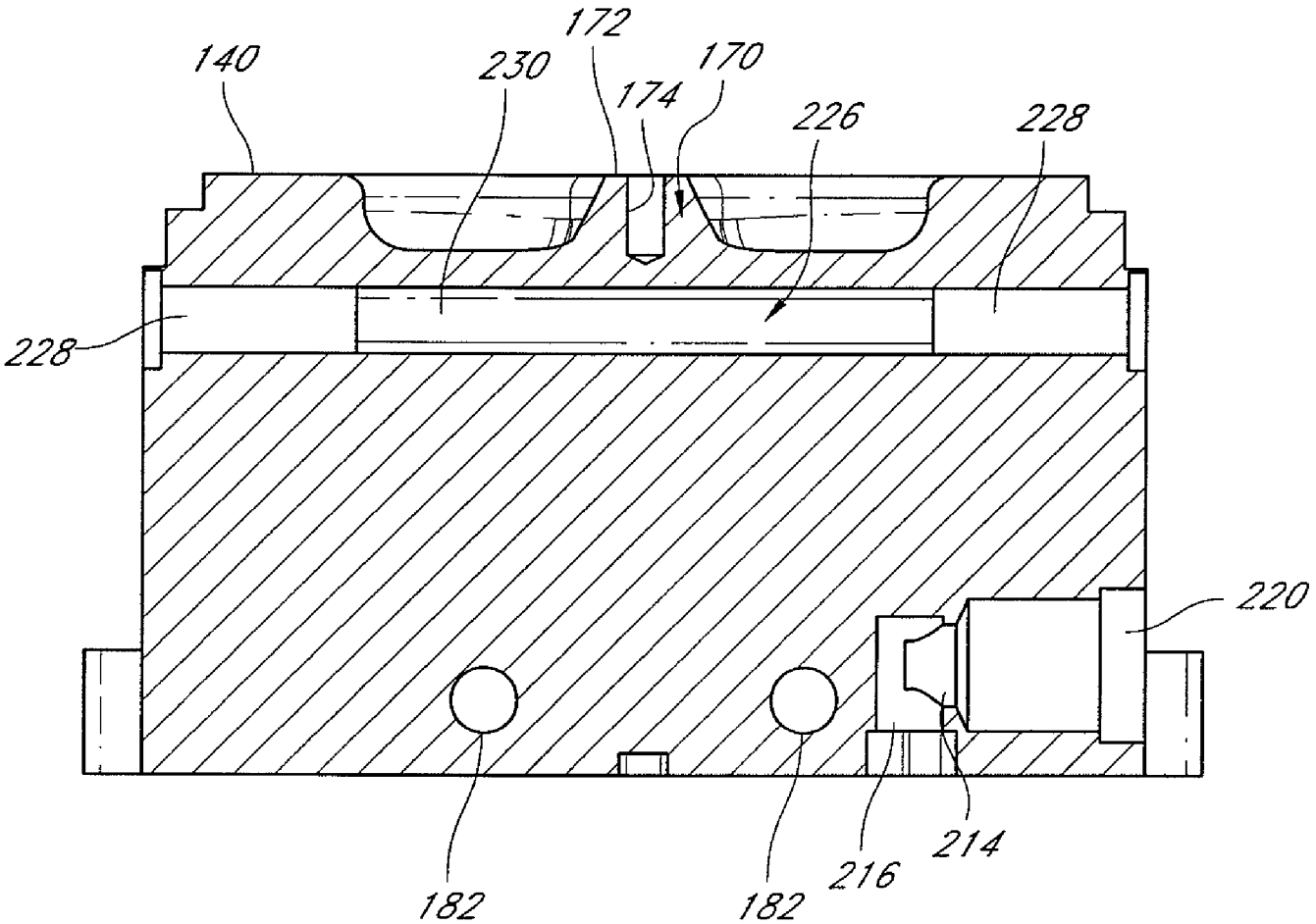
FIG. 6 is another sectioned view of the throttle body of FIG. 3.

With reference now to FIG. 3 and FIG. 6, a mounting boss 170 is provided generally centrally among the passages 146, 148, 150, 152. The mounting boss 170 preferably has an upper surface 172 that is generally flush with the upper surface 140. The mounting boss 170 generally comprises a threaded opening 174. The threaded opening 174 can receive a threaded rod (not shown) or the like such that an air cleaner or other auxiliary structures can be secured to the fuel injection body 100. Other arrangements for mounting an air cleaner or the like also can be used.

Figure 5:
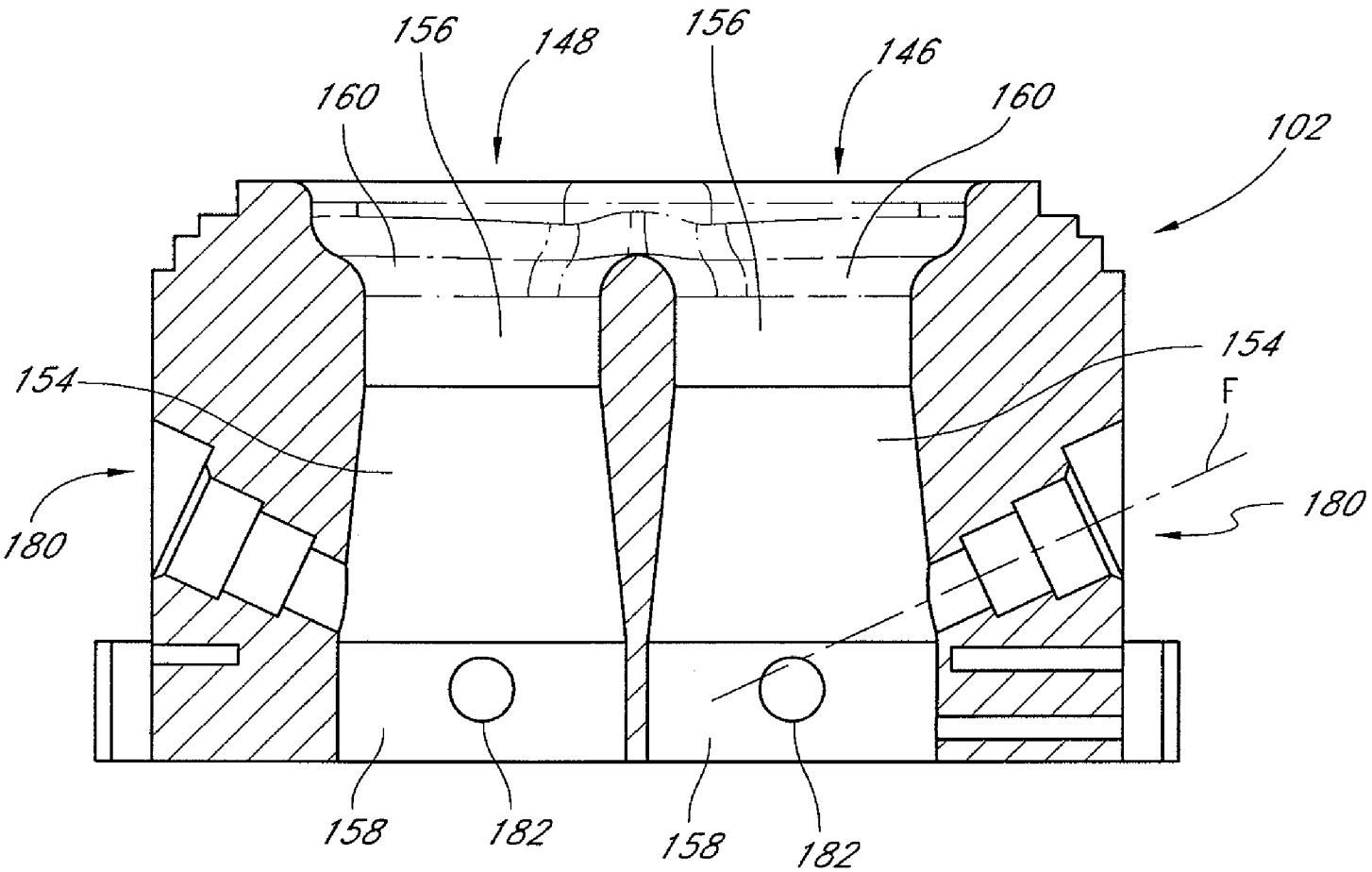
FIG. 5 is a sectioned view of the throttle body of FIG. 3.

With reference to FIG. 3 and FIG. 6, each passageway 146, 148, 150, 152 intersects with a fuel injector receptacle 180. The receptacles 180 can have any desired configuration and orientation. Preferably, each of the receptacles 180 extends from a side surface of the main throttle body 102 into a corresponding one of the passageways 146, 148, 150, 152. In the illustrated configuration, the receptacles 180 are angled downward toward the lower cylindrical portions 158 of the passageways. Preferably, as shown in FIG. 5, a centerline F of each receptacle 180 extends at an angle downward and is positioned such that the centerline F extends to a location just above a throttle valve shaft aperture 182. In this manner, the fuel injectors direct fuel to cover upper surface the throttle blade to improve fuel atomization. In one configuration, the fuel injectors will be mounted at about 23 degrees. Other configurations are possible. As also shown in FIG. 5, the receptacle 180 preferably is defined as a multiple step bore. Other configurations and orientations are possible depending upon the application.

Figure 7:
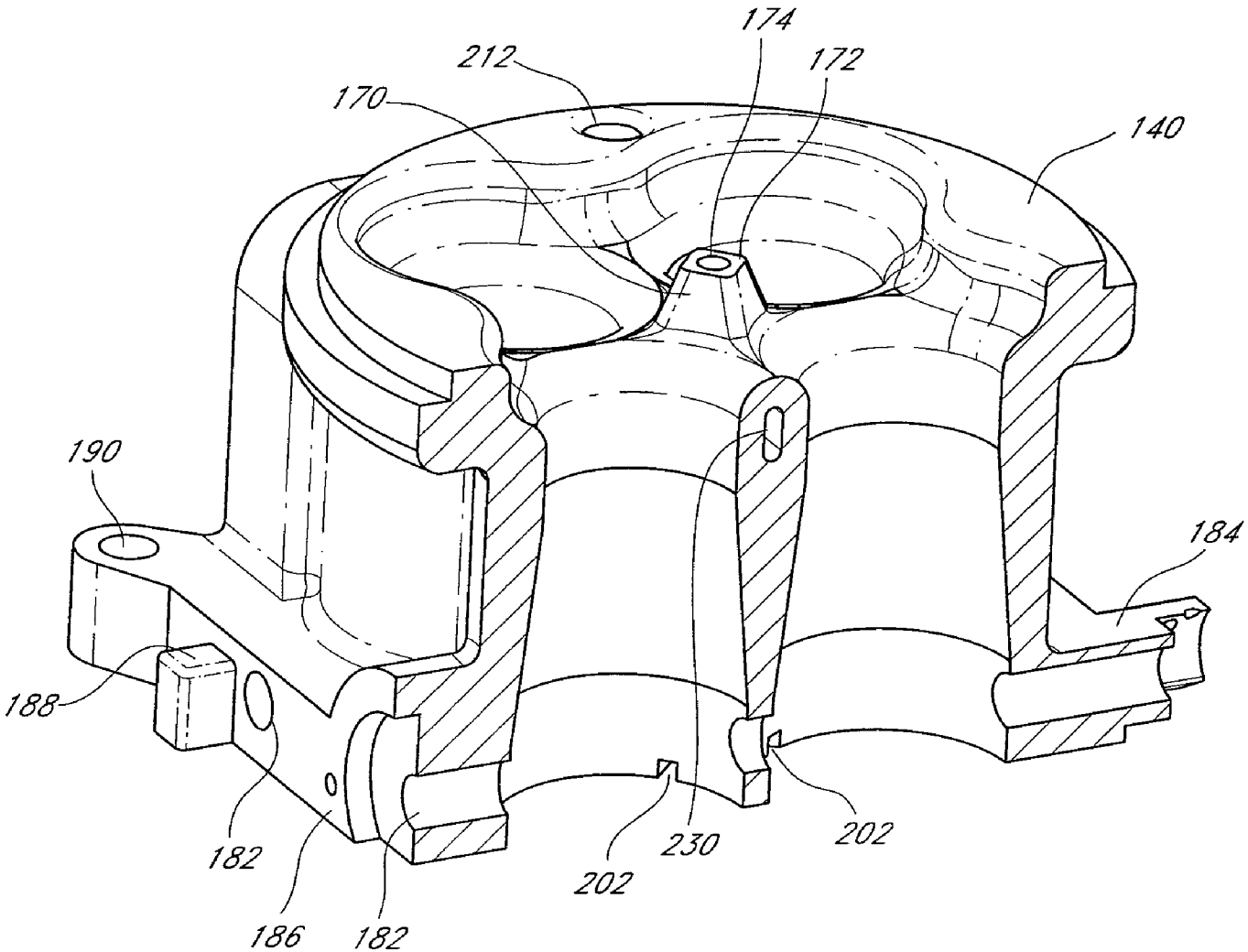
FIG. 7 is a further sectioned view of the throttle body of FIG. 3.

With reference now to FIG. 7, two throttle shaft apertures 182 are shown, which apertures 182 preferably extend fully through the main throttle body 102. The apertures 182 can be sized and configured to accommodate a throttle shaft, which is attached to suitable throttle valve, such as a throttle plate or the like. The throttle shafts will be rotatable within the throttle shaft apertures 182.

The apertures 182 preferably are positioned within the portion of the main throttle body 102 containing the lower flange 142 but other positions are possible. A throttle linkage (not shown) can be secured to the left side of the lower flange 142. In the illustrated configuration, a throttle linkage mount 184 (see FIG. 1) is provided. Preferably, the throttle linkage mount 184 is provided to the forward throttle shaft and, therefore, is positioned proximate the left side of the forward aperture 182. As shown in FIGS. 3 and 7, for example, a throttle position sensor mount 186 can be provided proximate the right forward aperture 182. Any suitable throttle position sensor (not shown) can be mounted to the throttle position sensor mount 186. With continued reference to FIG. 7, an adjustment mount block 188 also can be provided along the right side of the main throttle body 102. A portion of the throttle linkage can be secured to the right side of the main throttle body 102, which portion can comprise a secondary adjustment screw used to adjust an idle speed of the associated engine.

With reference to FIGS. 1 and 3, the lower flange 142 preferably comprises mounting holes 190. The mounting holes 190 can be positioned in locations determined by generally standard locations used in the engine arts. The mounting holes 190 also can be formed in portions of the lower flange 142 that define ears or the like such that sufficient material surrounds the holes 190 to provide a stable mounting configuration.

Figure 8:
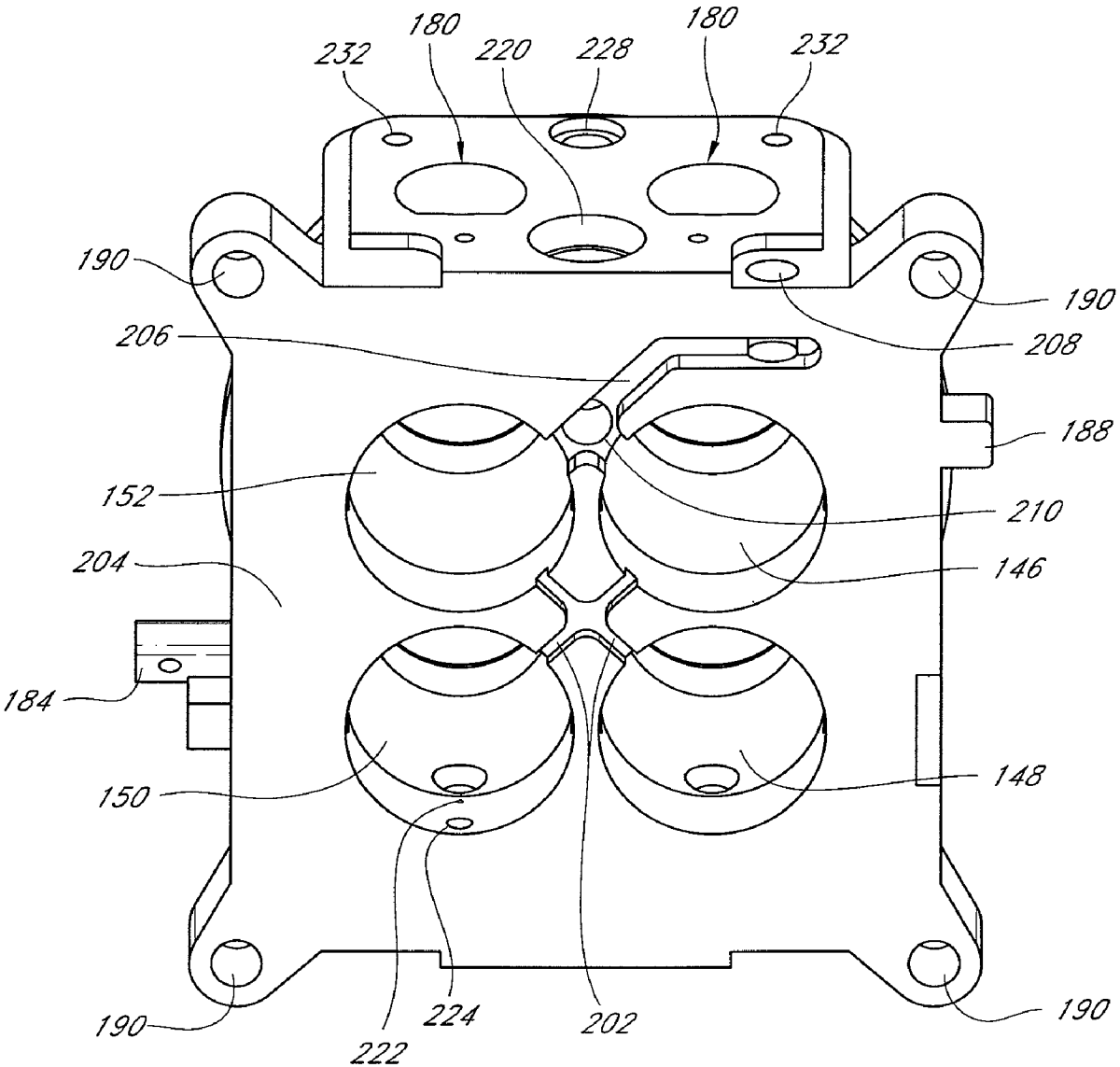
FIG. 8 is a bottom perspective view of the throttle body of FIG. 3.
Figure 9:
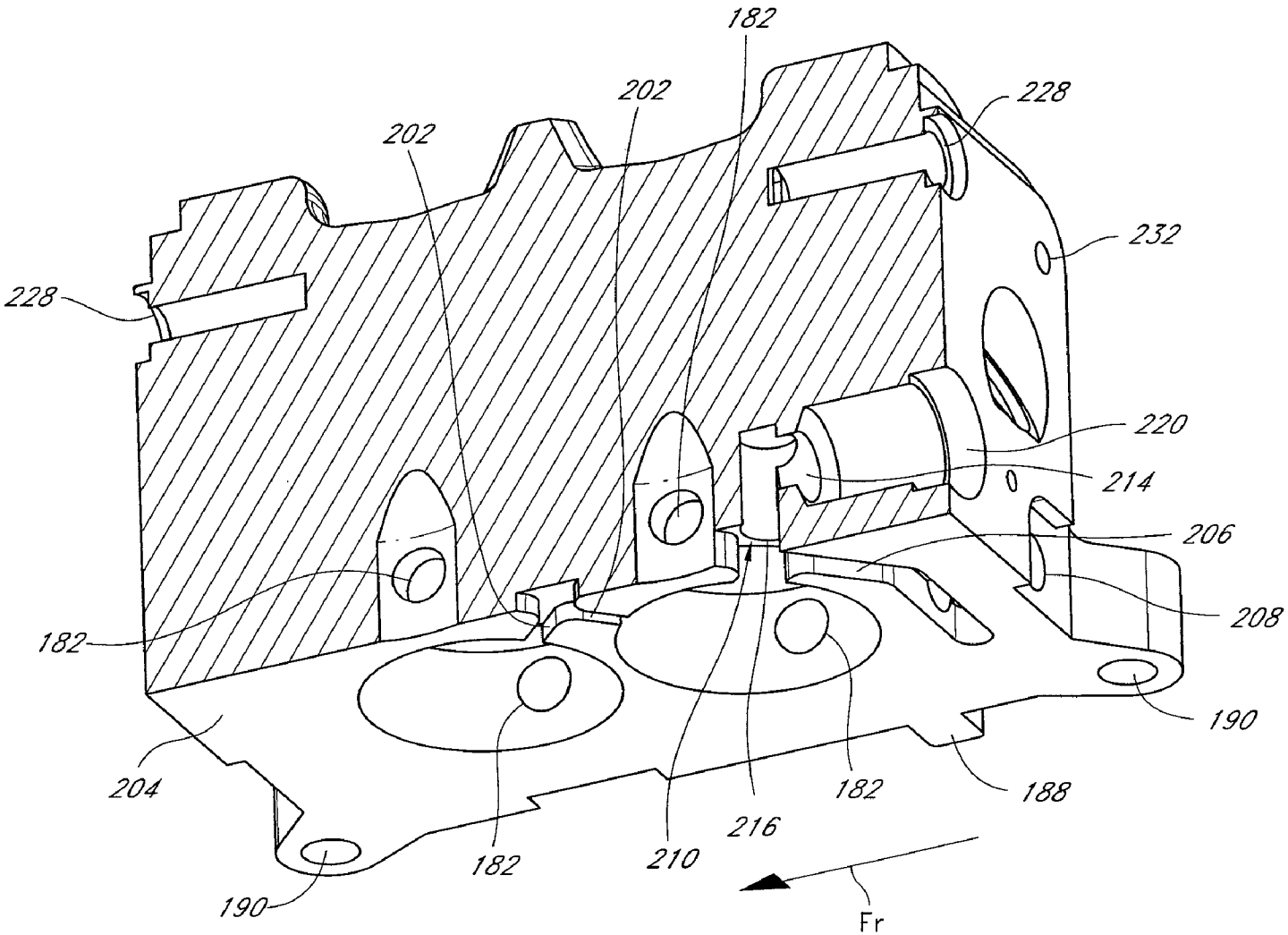
FIG. 9 is a further sectioned view of the throttle body of FIG. 3.
Figure 10:
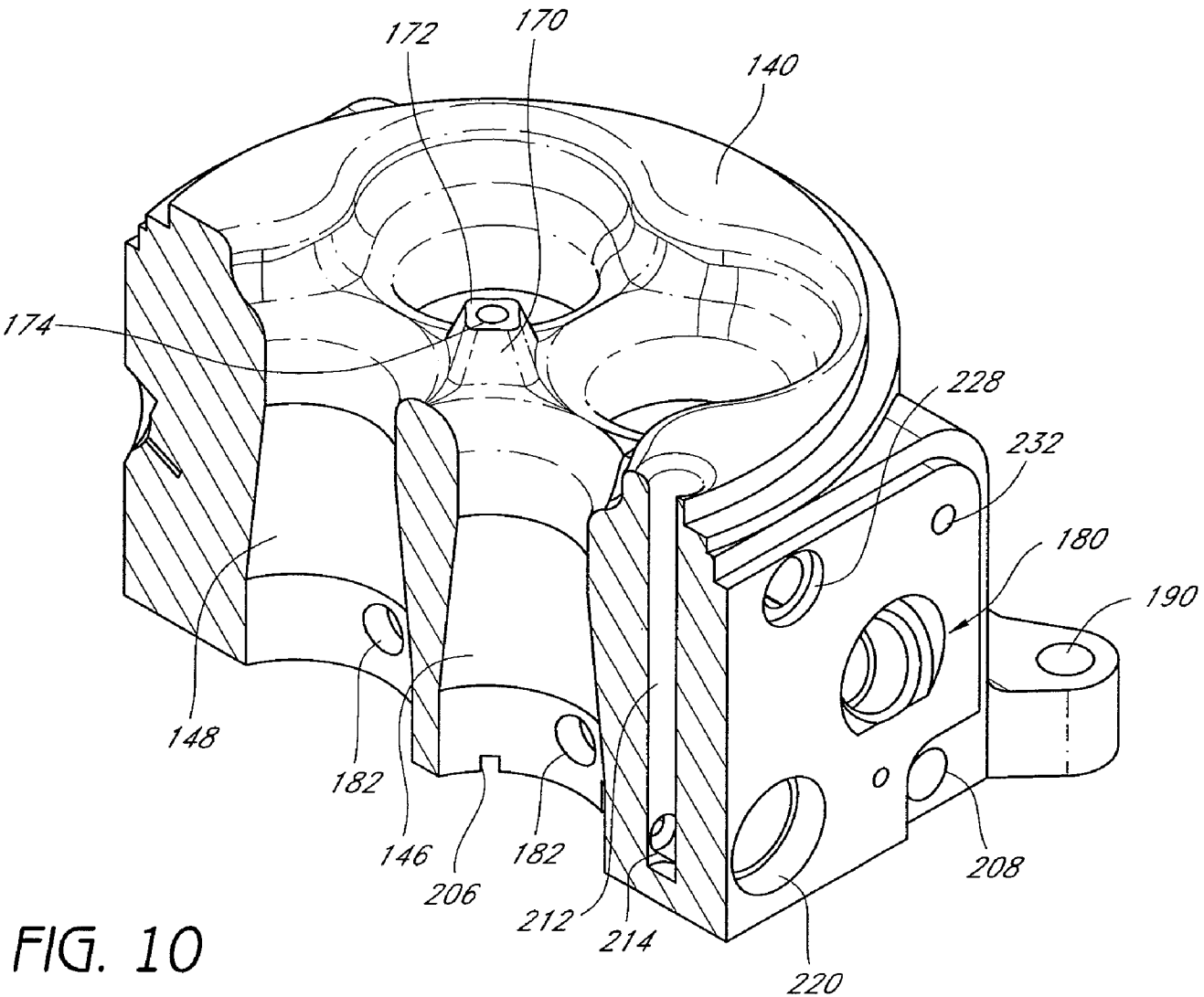
FIG. 10 is a sectioned view of the throttle body of FIG. 3.

With reference now to FIGS. 8-10, the throttle body 102 comprises a vacuum passage 200. The vacuum passage 200 comprises a pair of communication passages 202 that cross each other. Each of the communication passages 202 extends between two of the passages 146, 148, 150, 152 such that the four passages 202 are placed into fluid communication. Any other suitable interconnecting structures can be used. Advantageously, the passages 202 are formed on a lower surface 204 of the throttle body 102. Such a position simplifies the manufacture of the throttle body.

With reference to FIG. 9, at least one and preferably at least two of the passages 146, 152 are connected to a vacuum outlet passage 206. As shown in FIG. 9, at least a portion of the vacuum outlet passage 206 preferably is formed in the lower surface 204 of the throttle body. The illustrated vacuum outlet passage 206 extends to a direct vacuum outlet 208, to which a fitting (not shown can be connected). In the illustrated configuration, the direct vacuum outlet 208 will be positioned facing the rear direction of the throttle body 102 and the direct vacuum outlet 208 will be larger than two other vacuum outlets described below. In one preferred configuration, the direct vacuum outlet 208 can be connected to power brakes and/or a positive crankcase ventilation system (PCV).

With continued reference to FIG. 9, an idle air control passage 210 also can be connected directly to at least one, and more preferably to at least two of the passages 146, 152. The idle air control passage 210 comprises an idle air inlet passage 212 (see FIG. 10), an idle air control valve passage 214 (see FIG. 9) and an idle air outlet passage 216 (see FIG. 9). An idle air control valve mount 220 can be positioned such that an idle air control valve (not shown) can be secured in the mount 220 to control air flow through the idle air control passage 210. Any other suitable configuration can be used.

In the illustrated configuration, the idle air inlet passage 212 extends between the top surface 140 and a location within the throttle body 102. The air inlet passage 212 can have other configurations. The illustrated air inlet passage 212, however, advantageously is easy to manufacture. Moreover, in the illustrated configuration, an axis of the air inlet passage 212 is offset from the idle air outlet passage 216.

With reference now to FIG. 8, a first vacuum passage 222 and a second vacuum passage 224 extend from one or more of the passages 146, 148, 150, 152. In the illustrated configuration, the first and second vacuum passages 222, 224 extend from the passage 150, which is not directly communicating with the vacuum outlet passage 206. Moreover, in the illustrated configuration, the lower or second vacuum passage 224 has a larger diameter at the end that intersects the passage 150 relative to the upper or first vacuum passage 222.

A port (not shown) preferably is connected to each of the first and second vacuum passages 222, 224 on the outside surface of the throttle body 102. The ports can be 3/16 of an inch in one configuration. Preferably, the ports can be used to connect the throttle body 102 to vacuum accessories and to a MAP sensor. More preferably, the lower port, which corresponds to the larger second vacuum passage 224, is a direct vacuum connection that can be connected to the MAP sensor. When used with a boosted engine, a zip tie or the like can be used to secure a MAP hose to reduce the likelihood of the hose being blown off of the port. The upper port, which corresponds to the smaller first vacuum passage 222, is a ported vacuum connect that can be connected to vacuum advance distributors and automatic transmissions (i.e., using a tee splitter or the like, where desired).

With reference to FIG. 6, the throttle body 102 advantageously comprises a crossover fuel passage 226. The crossover passage 226, as will be explained, allows fuel to be passed from one side of the fuel injection body 100 to the other side. Thus, fuel can be supplied from fuel lines to either end of the fuel injection body 100 with fuel being passed through the crossover passage 226 to the other end of the fuel injection body 100. The illustrated crossover passage 226 comprises generally cylindrical ends 228 and an oblong cross-section through its central portion 230 (see FIG. 7). The oblong central portion 230 allows the passage 226 to extend between the air passages 146, 148, 150, 152. Other configurations can be used.

With reference again to FIG. 1 and FIG. 2, the throttle body 102 is connected to the first end cap 104 and the second end cap 106. Threaded openings 232 are provided on the ends of the throttle body 102 so that threaded fasteners (not shown) can be used to secure the end caps 104, 106 to the throttle body 102. Other configurations also can be used.

The end caps 104, 106 preferably are substantially identical to each other. By forming the end caps 104, 106 to be identical, manufacturing costs can be reduced and manufacturing and assembly can be simplified. Other configurations also can be used.

Figure 11:
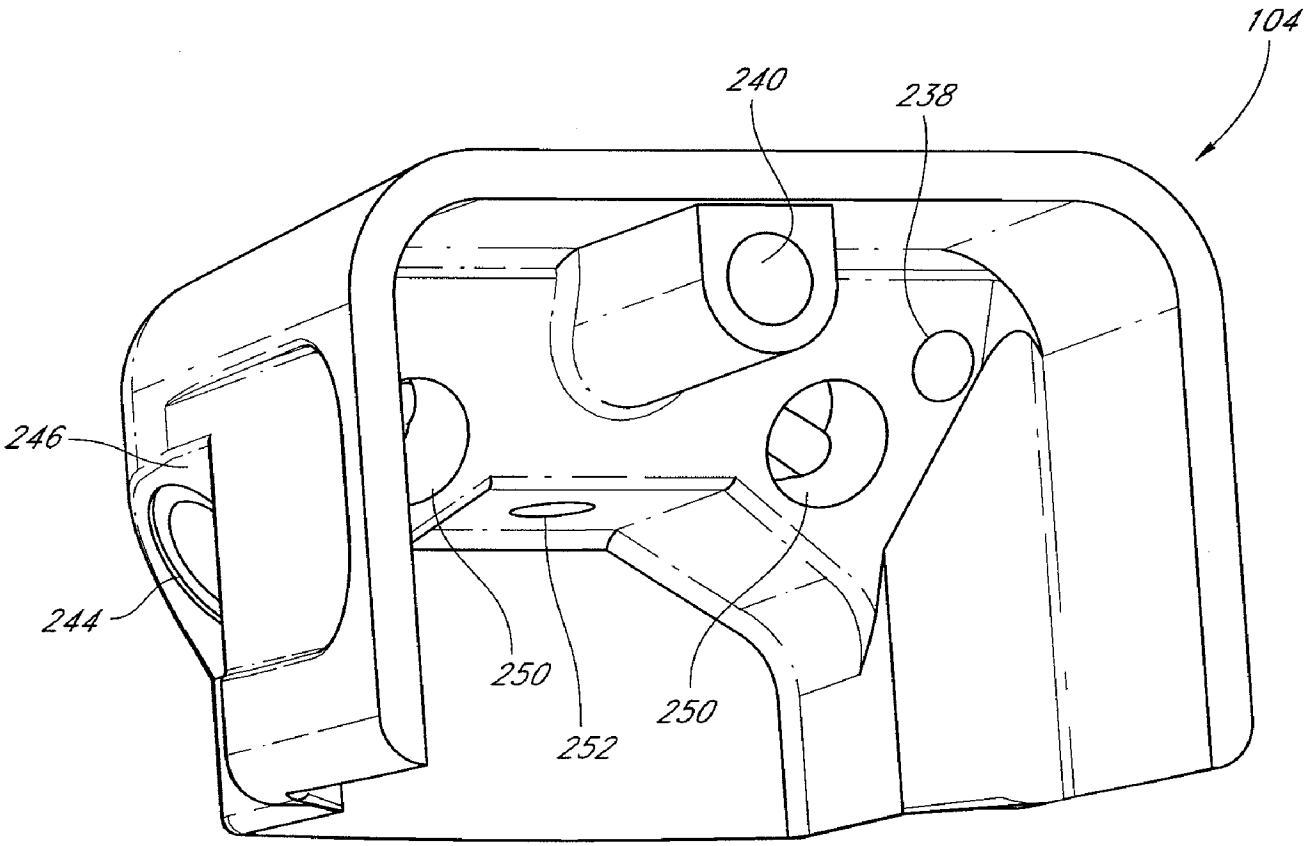
FIG. 11 is a view of an end cap of the fuel injection unit of FIG. 1.

With reference now to the perspective view of FIG. 11, one of a pair of mounting holes 238 is shown. The mounting holes 238, also shown in FIG. 1, for instance, receive the threaded fasteners (not shown) that thread into the threaded openings 232 provided on the ends of the throttle body 102. The mounting holes 238 can have any suitable configuration. In the illustrated configuration, the mounting holes 238 are countersunk such that the threaded fasteners (not shown) can be substantially concealed within the mounting holes 238. In other configurations, the mounting holes 238 can be arranged and configured to expose the ends of the threaded fasteners for aesthetic reasons.

With continued reference to FIG. 11, a crossover connector passage 240 is shown. One end of the connector passage 240 joins with the crossover passage 226. The other end of the connector passage 240 extends into a fuel line housing portion of the end cap 104. In particular, as shown in the cross-section of FIG. 12, the connector passage 240 generally extends to an intersection of two inclined fuel distribution passages 242, 242. Other configurations also can be used.

Each of the illustrated inclined fuel distribution passages 242, 242 extends upward at an angle from a fuel introduction port 244 to the connector passage 240. While the illustrated configuration features inclined fuel distribution passages 242, 242, other configurations are possible. The illustrated configuration, however, provides a pleasing aesthetic appearance. As illustrated, the fuel introduction ports 244 are positioned on a downwardly and outwardly facing surface 246. Other placements also can be used.

Figure 12:
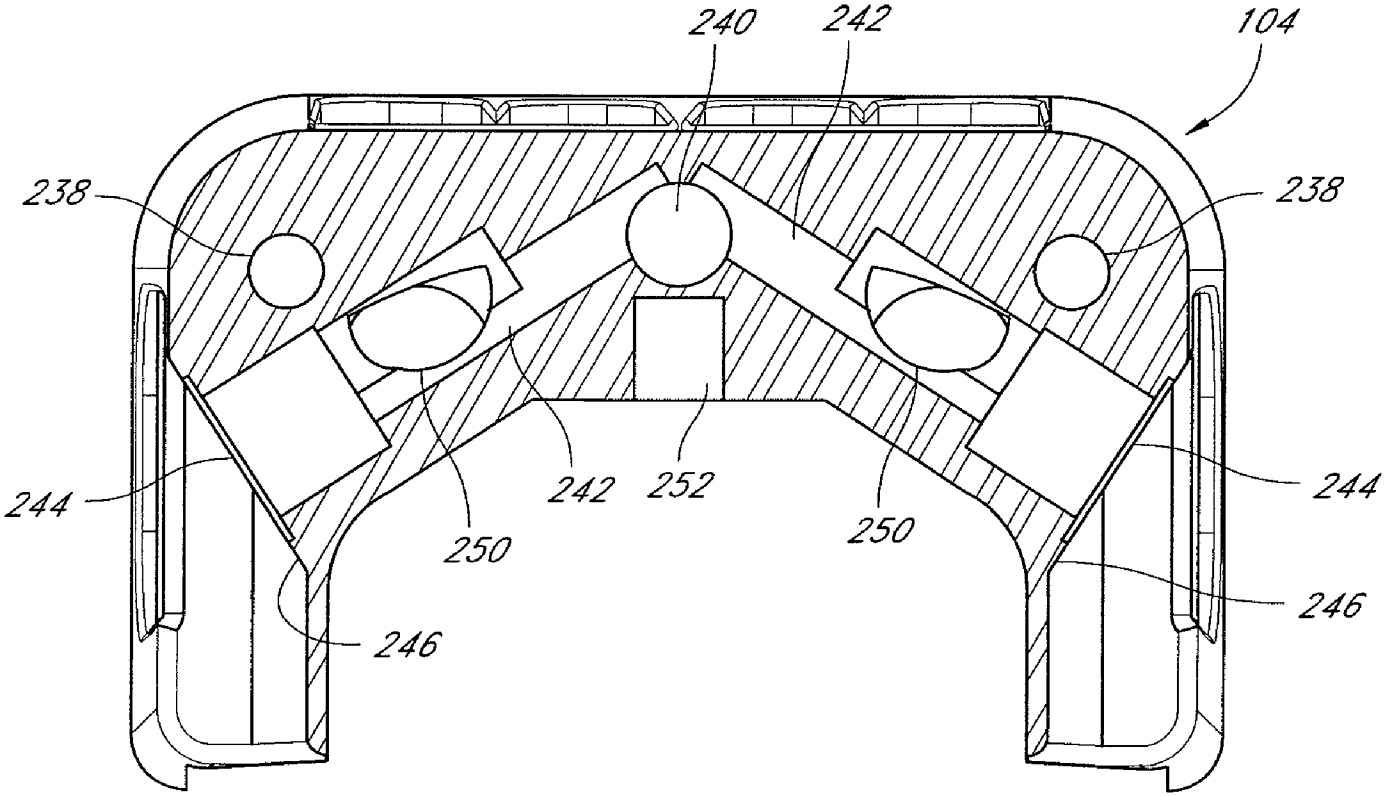
FIG. 12 is a sectioned view of the end cap of FIG. 11.

With continued reference to FIG. 12, a fuel injector supply port 250 can be positioned along each of the fuel distribution passages 242 at a location between the fuel introduction port 244 and the connector passage 240. Thus, fuel supplied to the fuel distribution passages 242 can be supplied to the fuel injectors 110, 112, 114, 116. In the illustrated configuration, a returnless system can be provided. The returnless system typically would comprise a fuel supply hose being connected to one of the fuel introduction ports 244 with the remaining fuel introduction ports 244 being capped of with a suitable plug. Thus, fuel would pass from the fuel introduction port through the fuel distribution passages of one end cap 104, through the associated connector passage 240, through the crossover passage 226, through the other connector passage 240, and into the fuel distribution passages 242, 242 of the other end cap 106, for instance. The fuel in the four fuel distribution passages 242 would then be supplied to the fuel injectors 110, 112, 114, 116.

Thus, in the preferred configuration, the fuel supply system advantageously is fully integrated into the fuel injection body 100 without the need for external fuel hoses with the exception of a supply hose and, in some configurations, a return hose (e.g., in greater than 500 horsepower applications). Moreover, in the illustrated configuration, the fuel supply hose can be mounted to either the front or rear fuel introduction ports 244 on either side of the fuel injection body 100. In some configurations, two fuel supply hoses can be used to provide fuel separately to each of the end caps 104, 106 in a dual feed configuration.

A fuel pressure sensor (not shown) can be directly mounted to the fuel supply system discussed directly above. In one configuration, a port 252 can open into the connector passage 240 at a location generally corresponding to the intersection of the connector passage 240 with the fuel distribution passages 242. Thus, the fuel pressure sensor can be mounted directly to the fuel supply system of the fuel injection body 100. Advantageously, by positioning the port in the illustrated configuration, the fuel pressure sensor can be concealed from view once the fuel injection body 100 has been mounted to an engine, which concealed location renders an improved appearance for the fuel injection body.

Figure 13:
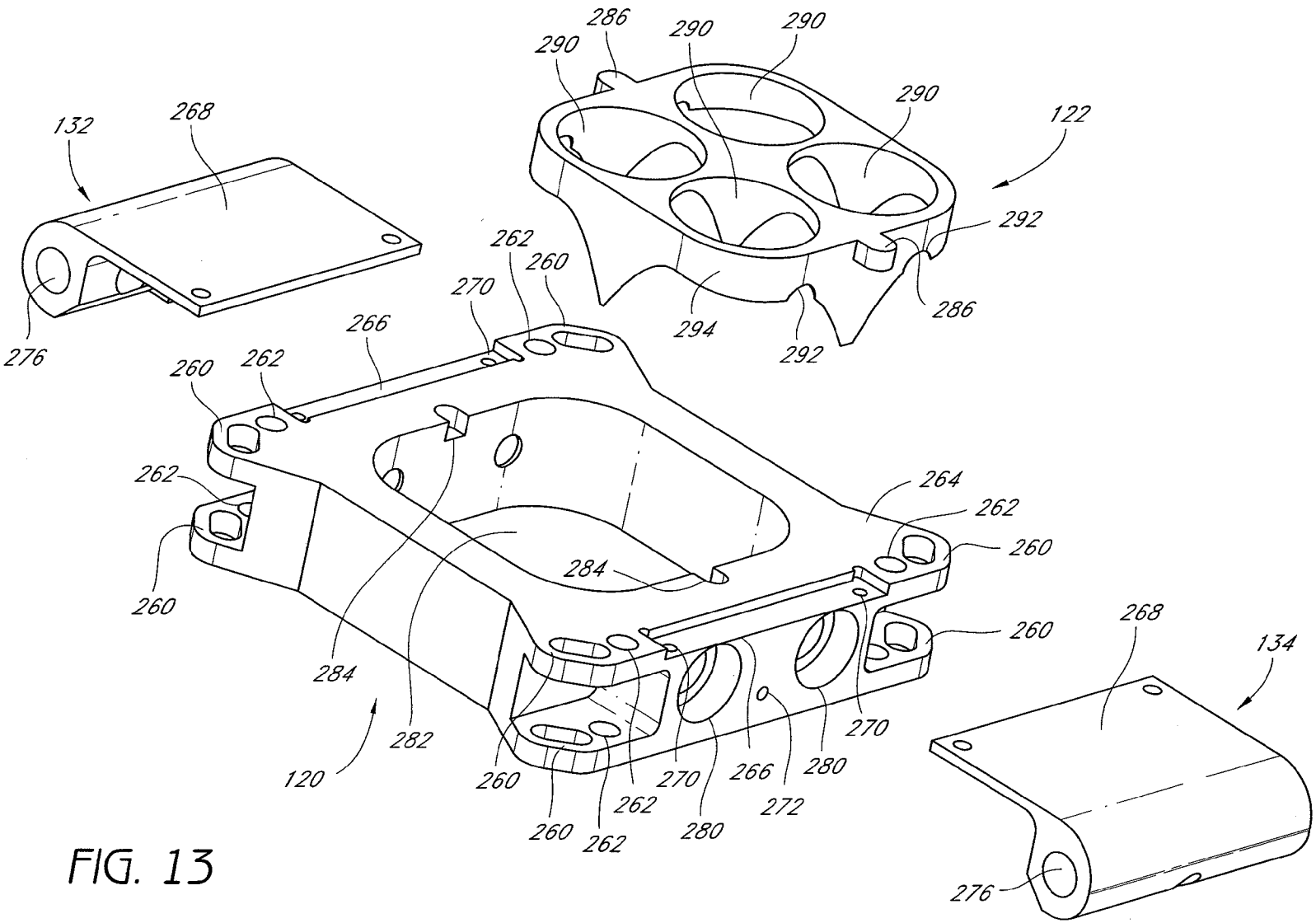
FIG. 13 is an exploded perspective view of an auxiliary injector plate of the fuel injection unit of FIG. 1.

With reference now to FIG. 13, the auxiliary injector plate 120 preferably provides a structure to which four auxiliary fuel injectors and the associated fuel supply system can be coupled to the main throttle body 102 of the fuel injection body 100. As illustrated, the injector plate 120 preferably comprises four spaced pairs of slotted openings 260. The slotted openings 260 allow rotation in the mounting orientation of the throttle plate while still matching the openings. In other words, the slots facilitate mounting of the plate 120 in any orientation (e.g., side to side or front to back). The plate also acts as an adaptor for bolting to a variety of aftermarket intake manifolds. Mounting holes 262 also are provided in spaced pairs.

With continued reference to FIG. 13, an upper surface 264 of the plate 120 preferably comprises a pair of mounting recesses 266. The mounting recesses 266 are sized and configured to receive a portion of the associated fuel rail 132, 134. A mounting plate 268 of the fuel rail 132, 134 can be secured within the mounting recess 266 through threaded fasteners or the like. The mounting plate 268 can be a single component that extends the length of the fuel rail 132, 134 or it can be two or more fingers that extend outward from the plate 120. In the illustrated configuration, threaded holes 270 are provided on the plate 120 that receive threaded fasteners (not shown). Other mounting configurations also can be used. A third threaded hole 272 extends generally normal to the other threaded holes 270 and the third threaded hole 272 also is used to secure the associated fuel rail 132, 134 in position.

The plate 120 defines four fuel injector receptacles 280. The fuel injector receptacles receive the fuel injectors 124, 126, 128, 130 and position them for injection into passages that will be discussed below. The fuel injectors 124, 126, 128, 130 are coupled to the fuel rails 132, 134 in any suitable manner. Thus, the fuel injectors 124, 126, 128, 130 extend between the fuel rails 132, 134 and the plate 120. The illustrated fuel rails 132, 134 each define a fuel supply passage 276 that extends from one side of the fuel rail 132, 134 to the other side. Thus, the fuel rail can have fuel lines coupled to one side of the fuel rail with the other side being plugged. In this manner, the fuel rails 132, 134 provide flexibility in configuring the fuel supply system.

An inner opening 282 of the plate 120 receives the adaptor 122. The plate 120 and the adaptor 122 comprise an interlocking mechanical structure. In the illustrated configuration, the plate 120 comprises two shallow grooves 284 while the adaptor 122 comprises two tabs 286. The tabs 286 are received within the grooves 284 such that the adaptor is correctly oriented and supported within the opening 282. Other configurations also can be used. As illustrated, the adaptor 122 can rest within the opening and be supported therein.

The adaptor 122 preferably comprises openings 290 that generally align with the passages 146, 148, 150, 152. The adaptor 122 also preferably is shaped and configured to reduce interference with fuel injected by the fuel injectors 124, 126, 128, 130. For instance, cutouts 292 can be provided in side walls 294 of the adaptor 122. Other configurations also can be used.

The illustrated fuel injection body 100 can be used with or without the injector plate 120. The injector plate 120 provides a second set of injectors for use in certain applications, as desired. In some applications, a blank end cap can be used on one or both ends of the throttle body and fuel injectors on that side of the throttle body or on those sides of the throttle body can be omitted such that the fuel injection body functions solely as a throttle body. Thus, many variations can be made of the basic construction.

Figure 14:
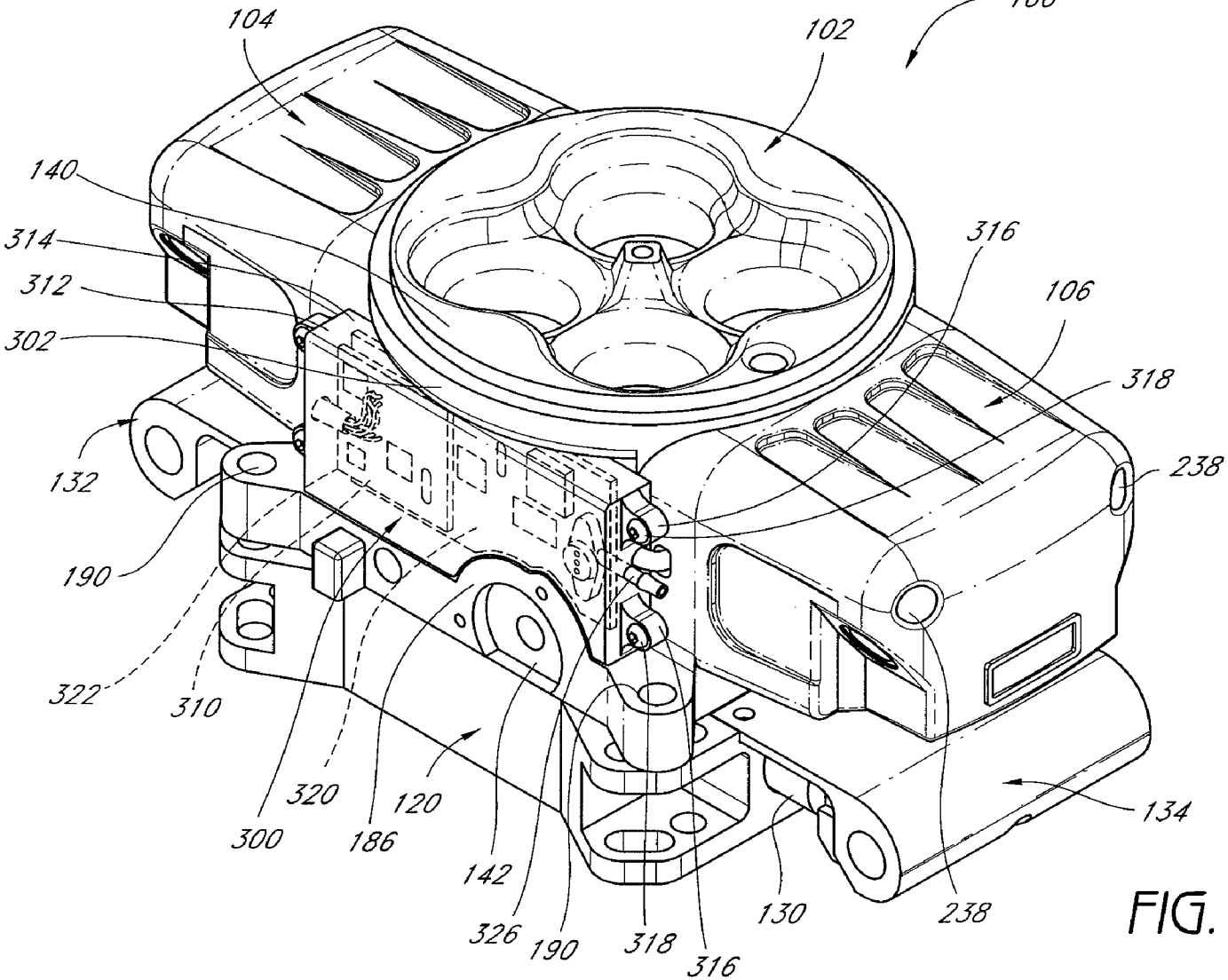
FIG. 14 is a perspective view of an assembly showing the throttle body of FIG. 1 with a small computer mounted to the throttle body.
Figure 15:
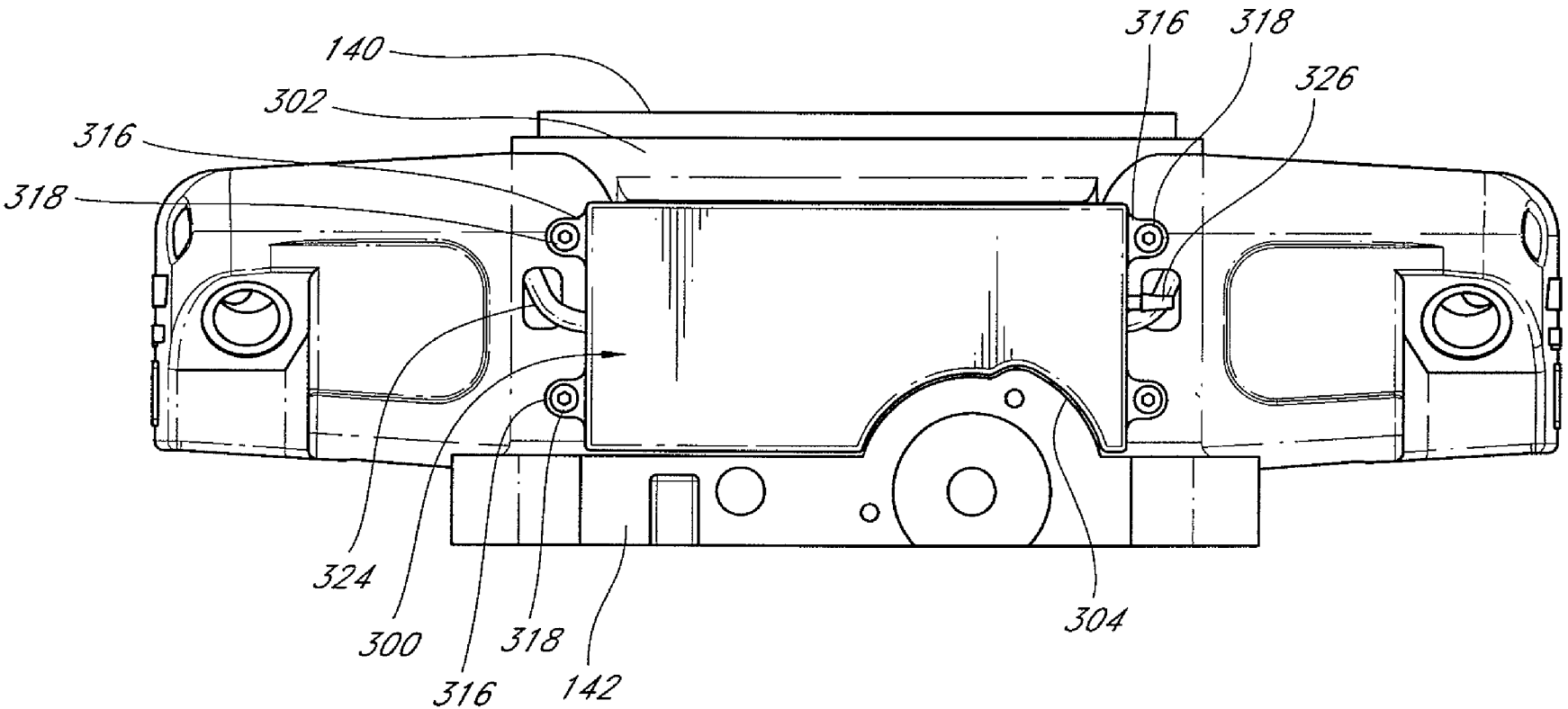
FIG. 15 is a side view of the assembly of FIG. 15.

With reference now to FIGS. 14 and 15, a small housing 300 can be mounted to a side of the fuel injection body 100. As will be described, the housing 300 is sized and configured to house a circuit board 310 that can be used to control operations of the fuel injection body 100.

The housing 300 preferably is received with a recessed region defined along a side of the throttle body 102. In some configurations, the housing 300 is mounted vertically between a top portion 302 of the throttle body 102 (e.g., the rim that defines, at least in part, the outer peripheral surface adjacent to the top surface 140 of the throttle body 102) and the lower flange 142 of the throttle body. Stated another way, the housing 300 can be mounted along the main portion 144 of the main throttle body 102. By mounting the housing 300 directly to the fuel injection body 100, the fuel injection body 100 can be virtually self-contained with less wires running throughout the engine compartment. Moreover, by mounting the housing 300 within the recess defined in the main portion 144 of the main throttle body 102, the fuel injection body 100 can be compactly arranged while maintaining a virtually self-contained construction.

In the illustrated configuration, the housing 300 includes a wall 304 that defines a recess 306. The recess 306 preferably is sized and configured to accommodate a throttle position sensor (not shown), which can be mounted to the throttle position sensor mount 186. In the illustrated configuration, the wall 304 extends along a portion of the throttle position sensor mount 186. Such a configuration provides a more compact configuration. Moreover, by positioning the housing 300, and more particularly, the circuitry 310 contained within the housing 300, generally adjacent to the position sensor and the position sensor mount 186, the position sensor can be connected to the circuitry 310 with a relatively short length of wire.

With reference to FIG. 14, the housing 300 preferable is formed in two pieces: an outer lid 312 and an inner base 314. In some configurations, the outer lid 312 is sealed to the inner base 314 during manufacturing. In some configurations, the outer lid 312 is removably attached to the inner base 314. In some configurations, the outer lid 312 slides over a portion of the inner base 314. In some configurations, a seal (not shown) can be positioned between the inner base 314 and the outer lid 312 such that a water tight compartment can be defined by the housing 300.

In the illustrated configuration, the inner base 314 and the outer lid 312 are secured together to the fuel injection body 100. As illustrated, the housing 300 can comprise one or more mounting ears 316. The mounting ears receive threaded fasteners 318 in the illustrated configuration. Other suitable manners of securing the housing 300 to the fuel injection body 100 also can be used. In some configurations, a shock absorbing component can be used as part of the mounting structure such that the housing 300 can be better isolated from engine vibrations. The fasteners 318 secure the housing 300 to the throttle body 102. In some configurations, the housing 300 can be secured to other portions of the fuel injection body 100.

The circuitry 310 can be mounted inside of the housing 300 in any suitable manner. The circuitry 310 can comprise a main board 320 and a daughter board 322. In some configurations, the main board 320 can be electrically connected to the fuel injectors 110, 112, 114, 116 such that the main board 320, and particularly an ECU that is defined by the main board 320, can control the injection timing and amount. The daughter board 322 can be electrically connected to an oxygen sensor (not shown). The oxygen sensor can be a wideband oxygen sensor that can be mounted along a suitable portion of an exhaust system. In the illustrated configuration, a wire harness 324 extends from the daughter board 322 to the oxygen sensor. The circuitry 310 also can be connected to a serial cable (not shown) such that the circuitry 310 can be connected to an external computer for interaction with the external computer. Other configurations also are possible. As illustrated, a vacuum connection 326 also can be provided. The vacuum connection 326 can extend through the housing 300 and can be connected to a sensor that is mounted to the circuitry 310. Other configurations also are possible.

Although the present invention has been described in terms of a certain embodiment, other embodiments apparent to those of ordinary skill in the art also are within the scope of this invention. Thus, various changes and modifications may be made without departing from the spirit and scope of the invention. For instance, various components may be repositioned as desired. Moreover, not all of the features, aspects and advantages are necessarily required to practice the present invention. Accordingly, the scope of the present invention is intended to be defined only by the claims that follow.

What is claimed is:

1. A fuel injection unit comprising a main throttle body, said main throttle body comprising a first side surface, a second side surface, a top surface generally extending between said first side surface and said second side surface, a bottom surface generally extending between said first side surface and said second side surface, a first end cap secured to said first side surface, a second end cap secured to said second side surface, a first air passage extending between said top surface and said bottom surface and a second air passage also extending between said top surface and said bottom surface, a first fuel injector extending through said first side surface toward said first air passage, said first fuel injector being generally covered by said first end cap, a second fuel injector extending through said second side surface toward said second air passage, and said second fuel injector being generally covered by said second end cap.

2. The fuel injection unit of claim 1, wherein said first end cap is removable from said main throttle body.

3. The fuel injection unit of claim 1 further comprising a fuel introduction port formed in an exterior surface of said first end cap, said fuel introduction port being in fluid communication with said first fuel injector.

4. The fuel injection unit of claim 3 further comprising a fuel supply passage extending between said fuel introduction port and said first fuel injector, said fuel supply passage being formed in a wall of said first end cap.

5. The fuel injection unit of claim 4, wherein said fuel supply passage formed in said wall of said first end cap defines a first fuel supply passage, a second fuel supply passage being formed in a wall of said second end cap, said second fuel supply passage being in fluid communication with said second fuel injector, said first and second fuel supply passages being connected together by a connection passage, said connection passage extending through said main throttle body.

6. The fuel injection unit of claim 1, wherein said fuel introduction port defines a first fuel port, said first end cap further comprising a second fuel port, said first and second fuel ports being connected together and being connected to said first fuel injector.

7. The fuel injection unit of claim 6, wherein a fuel passage extends between the first and second fuel ports and the first fuel injector is fluidly connected to the fuel supply passage.

8. The fuel injection unit of claim 4 further comprising a fuel pressure sensor mount in fluid communication with said fuel supply passage, said fuel pressure sensor mount being adapted to receive a fuel pressure sensor such that said fuel pressure sensor can be positioned within said first end cap.

9. The fuel injection unit of claim 1 further comprising an idle air passage defined within said main throttle body, said idle air passage emerging through at least one of said first side surface and said second side surface at a location underlying the respective one of the first and second end caps.

10. The fuel injection unit of claim 1 further comprising an auxiliary injector plate secured to said bottom surface of said main throttle body.

11. The fuel injection unit of claim 10, wherein said auxiliary injector plate comprises fuel rails that generally overlie at least one fuel injector.

12. An auxiliary fuel injector plate comprising a top surface, a bottom surface spaced from and generally parallel to said top surface, a central passageway extending from said top surface to said bottom surface, an adaptor positioned within said central passageway, said adaptor comprising a plurality of openings, a first fuel injector extending into said central passageway, a first fuel rail mounted to said auxiliary fuel injector plate and extending laterally outward from said auxiliary fuel injector plate, said first fuel rail defining a fuel passage that is in fluid communication with said first fuel injector.

13. The auxiliary fuel injector plate of claim 12, wherein the first fuel injector is positioned below the adaptor.

14. The auxiliary fuel injector plate of claim 12, wherein said first fuel rail overlies at least a portion of said first fuel injector.

15. The auxiliary fuel injector plate of claim 12, wherein said top surface comprises a mounting recess and a portion of said first fuel rail is positioned within said mounting recess.

16. The auxiliary fuel injector plate of claim 12 in combination with a main throttle body, said auxiliary fuel injector plate being secured to a lower surface of said main throttle body.

* * * * *